US009531109B2

(12) United States Patent
Gao et al.

(10) Patent No.: US 9,531,109 B2
(45) Date of Patent: Dec. 27, 2016

(54) ELECTRICAL CONNECTOR HAVING AN IMPROVED STRUCTURE FOR ASSEMBLING A CONTACT MODULE TO AN INSULATIVE HOUSING

(71) Applicant: FOXCONN INTERCONNECT TECHNOLOGY LIMITED, Grand Cayman (KY)

(72) Inventors: Sheng-Pin Gao, Kunshan (CN); Dao-Kuan Zhang, Kunshan (CN); Chih-Ching Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/551,325

(22) Filed: Nov. 24, 2014

(65) Prior Publication Data

US 2015/0147914 A1 May 28, 2015

(30) Foreign Application Priority Data

Nov. 22, 2013 (CN) ..... 2013 2 0742442 U

(51) Int. Cl.
*H01R 25/00* (2006.01)
*H01R 13/514* (2006.01)
(Continued)

(52) U.S. Cl.
CPC ..... *H01R 13/514* (2013.01); *H01R 12/716* (2013.01); *H01R 13/6466* (2013.01);
(Continued)

(58) Field of Classification Search
CPC ..... H01R 13/514; H01R 13/6466; H01R 13/6594; H01R 13/7175; H01R 24/64; H01R 2201/04
(Continued)

(56) References Cited

U.S. PATENT DOCUMENTS 6,227,911 B1 * 5/2001 Boutros ..... H01R 13/719 439/490
6,474,999 B1 * 11/2002 Givens ..... H01R 24/64 439/38
(Continued)

FOREIGN PATENT DOCUMENTS

CN 101908682 B 5/2012

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector includes an insulative housing, a lower mating contact module, and an upper mating contact module. The insulative housing has a lower receiving cavity, an upper receiving cavity, and an intermediate wall located therebetween. The lower mating contact module has a lower insulating carrier and a set of lower mating contacts secured to the lower insulating carrier. The upper mating contact module has an upper insulating carrier and a set of upper mating contacts secured to the upper insulating carrier. The intermediate wall defines a lower passageway extending along a front-to-back direction and an upper passageway disposed above the lower passageway. The lower insulating carrier has a lower fixing arm inserted and fixed in the lower passageway, and the upper insulating carrier has an upper fixing arm inserted and fixing in the upper passageway.

20 Claims, 5 Drawing Sheets

(51) Int. Cl.
*H01R 12/71* (2011.01)
*H01R 13/6466* (2011.01)
*H01R 13/6594* (2011.01)
*H01R 13/717* (2006.01)
*H01R 24/64* (2011.01)

(52) U.S. Cl.
CPC ..... *H01R 13/6594* (2013.01); *H01R 13/7175* (2013.01); *H01R 24/64* (2013.01); *H01R 2201/04* (2013.01)

(58) Field of Classification Search
USPC ..... 439/638, 541.5
See application file for complete search history.

(56) References Cited

U.S. PATENT DOCUMENTS 6,540,564 B1 * 4/2003 Ko ..... H01R 24/64 439/489
6,702,610 B2 * 3/2004 Zheng ..... H01R 13/506 439/441
6,729,906 B1 * 5/2004 Simmons ..... H01R 13/65802 439/490
6,736,673 B1 * 5/2004 Simmons ..... H01R 24/64 439/541.5
6,761,595 B1 * 7/2004 Zheng ..... H01R 13/514 439/620.01
6,786,772 B1 * 9/2004 Liu ..... H01R 24/64 439/541.5
6,910,917 B2 * 6/2005 Chen ..... H01R 13/518 439/490
6,918,791 B2 * 7/2005 Wan ..... H01R 24/64 439/607.01
6,964,585 B2 * 11/2005 Blichasz ..... H01R 13/6666 439/540.1
7,033,210 B1 * 4/2006 Laurer ..... H01R 13/506 439/541.5
7,048,550 B2 * 5/2006 Hyland ..... H01R 31/005 439/540.1
7,052,315 B2 * 5/2006 Murr ..... H01R 13/6658 439/540.1
7,074,083 B2 * 7/2006 Hyland ..... H01R 13/6658 439/607.01
7,121,898 B2 * 10/2006 Murr ..... H01R 24/64 439/676
7,156,699 B1 * 1/2007 Liu ..... H01R 13/6625 439/607.55
7,189,119 B2 * 3/2007 Blichasz ..... H01R 13/6666 439/540.1
D559,186 S * 1/2008 Kelmer ..... D13/147
7,351,083 B2 * 4/2008 Biddle ..... H01R 13/6616 439/188
7,485,004 B2 * 2/2009 Liu ..... H01R 12/58 439/620.25
7,510,441 B2 * 3/2009 Zhang ..... H01R 13/514 439/620.18
7,674,136 B2 * 3/2010 Steinke ..... H01R 13/514 439/541.5
7,736,176 B2 * 6/2010 Zhang ..... H01R 24/64 439/541.5
7,775,828 B2 * 8/2010 Zhang ..... H01R 23/6873 439/540.1
7,786,009 B2 * 8/2010 Machado ..... H01R 13/514 438/676
7,819,699 B2 * 10/2010 Xu ..... H01R 13/514 439/620.09
7,837,511 B2 * 11/2010 Hsu ..... H01R 13/6658 439/676
8,206,183 B2 * 6/2012 Machado ..... H01R 13/514 439/541.5
8,403,701 B2 * 3/2013 Han ..... H01R 13/6594 439/541.5
8,454,382 B2 * 6/2013 Zhang ..... H01R 13/514 439/540.1
8,545,274 B2 * 10/2013 Purkis ..... H01R 13/719 439/668
8,579,661 B2 * 11/2013 Zhang ..... H01R 13/6587 439/540.1
8,678,857 B2 * 3/2014 Zhang ..... H01R 13/514 439/541.5
8,882,546 B2 * 11/2014 Machado ..... H01R 13/514 439/541.5
8,992,248 B2 * 3/2015 O'Malley ..... H01R 13/6469 439/541.5
9,077,120 B2 * 7/2015 Zhang ..... H01R 13/6658
9,172,189 B2 * 10/2015 Gao ..... H01R 13/6633
9,252,530 B2 * 2/2016 Zhang ..... H01R 13/514
2003/0087559 A1 * 5/2003 Korsunsky ..... H01R 13/6658 439/676
2003/0109174 A1 * 6/2003 Korsunsky ..... H01R 13/6658 439/541.5
2004/0132342 A1 * 7/2004 Lien ..... H01R 13/514 439/620.11
2008/0214057 A1 * 9/2008 Zhang ..... H01R 24/64 439/668
2008/0220656 A1 * 9/2008 Zhang ..... H01R 24/64 439/668
2008/0305680 A1 * 12/2008 Little ..... H01R 13/514 439/541.5
2009/0253293 A1 * 10/2009 Zhang ..... H01R 13/6658 439/541.5
2010/0124842 A1 * 5/2010 Bu ..... H01R 13/518 439/541.5
2011/0053418 A1 * 3/2011 Margulis ..... H01R 13/719 439/620.07
2011/0065325 A1 * 3/2011 Hsu ..... H01R 12/724 439/638
2011/0306242 A1 * 12/2011 Zhang ..... H01R 13/6658 439/607.01
2012/0196479 A1 * 8/2012 Chow ..... H01R 13/514 439/607.35
2012/0309233 A1 * 12/2012 O'Malley ..... H01R 13/6469 439/626

* cited by examiner

ELECTRICAL CONNECTOR HAVING AN IMPROVED STRUCTURE FOR ASSEMBLING A CONTACT MODULE TO AN INSULATIVE HOUSING

BACKGROUND OF THE INVENTION

1. Field of the Invention

The present invention relates to an electrical connector having a contact module and an insulative housing, and more particularly to a structure for fixing the contact module to the insulative housing.

2. Description of Related Art

U.S. Pat. No. 7,736,176, issued on Jun. 15, 2010, discloses an electrical connector including an insulative housing, a contact module mounted to the insulative housing, and a shielding shell enclosing the insulative housing and the contact module. The contact module has a mating contact module, a center bracket, a first vertical PCB mounted to a side of the center bracket, a second vertical PCB mounted to an opposite side of the center bracket, and a mounting contact module connecting with bottoms of the vertical PCBs. The mating contact module has an insulating carrier, a set of upper mating contacts, and a set of lower mating contacts. The upper and lower mating contacts are secured to the insulating carrier. The insulating carrier has two guiding bars extending along a front-to-back direction at two opposite sides thereof. The guiding bars are used for guiding the mating contact module to assemble with the insulative housing. The center bracket has a top wall with a top wedge and a front wall with a front wedge. The contact module is fixed to the insulative housing by engaging the top and front wedges with the insulative housing. The top and front wedges are separated too far apart that it is difficult to mount the contact module to the insulative housing. After the assembling process, the contact module may not be fixed stably to the insulative housing. Moreover, the center bracket has a part located behind the front or top wedge such that there is a need to provide a slider core running along the top-to bottom direction during molding operation in order to form the wedge.

U.S. Pat. No. 7,837,511, issued on Nov. 23, 2010, discloses an electrical connector including an insulative housing, a contact module mounted to the insulative housing, a front shielding shell, and a rear shielding shell. The contact module also has a middle bracket, two sets of mating contacts, and an insulating carrier for holding the mating contacts. The insulating carrier has two guiding bars extending along a front-to-back direction at two opposite sides thereof The guiding bars are used for guiding the contact module to assemble with the insulative housing. The middle bracket has a top protrusion and a bottom protrusion for engaging with the insulative housing. The top and front protrusions are separated too far apart that it is difficult to mount the contact module to the insulative housing. The bracket has a part located behind the front or top protrusion such that there is a slider core running along the top-to bottom direction to form the protrusion.

Further in U.S. Pat. No. 7,837,511, the insulative housing has a receiving cavity for receiving a plug connector and a top wall with a latching slit for locking with the plug connector. The receiving cavity extends along a front-to-back direction, and the latching slit extends through the top wall along a top-to-bottom direction. There are a mold die core molding backwardly to form the receiving cavity and a slider core running along the top-to bottom direction to form the latching slit when injection molding the insulative housing, thus complicating injection molding process of the insulative housing.

Hence, an electrical connector having an improved structure for assembling is desired.

SUMMARY OF THE INVENTION

Accordingly, an object of the present invention is to provide an electrical connector having an improved structure for assembling a contact module to an insulative housing.

In order to achieve the object set forth, the invention provides an electrical connector including an insulative housing, a lower mating contact module, and an upper mating contact module. The insulative housing has a lower receiving cavity, an upper receiving cavity, and an intermediate wall located therebetween. The lower mating contact module has a lower insulating carrier and a set of lower mating contacts secured to the lower insulating carrier. Each lower mating contact has a lower contacting portion extending downwardly and backwardly into the lower receiving cavity. The upper mating contact module having an upper insulating carrier and a set of upper mating contacts secured to the upper insulating carrier. Each upper mating contact has an upper contacting portion extending upwardly and backwardly into the upper receiving cavity. The intermediate wall defines a lower passageway extending along a front-to-back direction and an upper passageway disposed above the lower passageway. The lower insulating carrier has a lower fixing arm inserted and fixed in the lower passageway, and the upper insulating carrier has an upper fixing arm inserted and fixing in the upper passageway. The fixing arms engage with the insulative housing. The lower and upper fixing arms are disposed on the mating contact module and close to each other that it is easy to assemble the contact module to the insulative housing. After the assembling process, the contact module is fixed reliably to the insulative housing. The fixing arms are disposed on the insulating carriers, so that it can omit a slider core running along the top-to bottom direction to form the fixing arms.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-5, an electrical connector 100 according to the present invention is shown. The electrical connector 100 could be mounted on a horizontal mother PCB 200.

Figure 2:
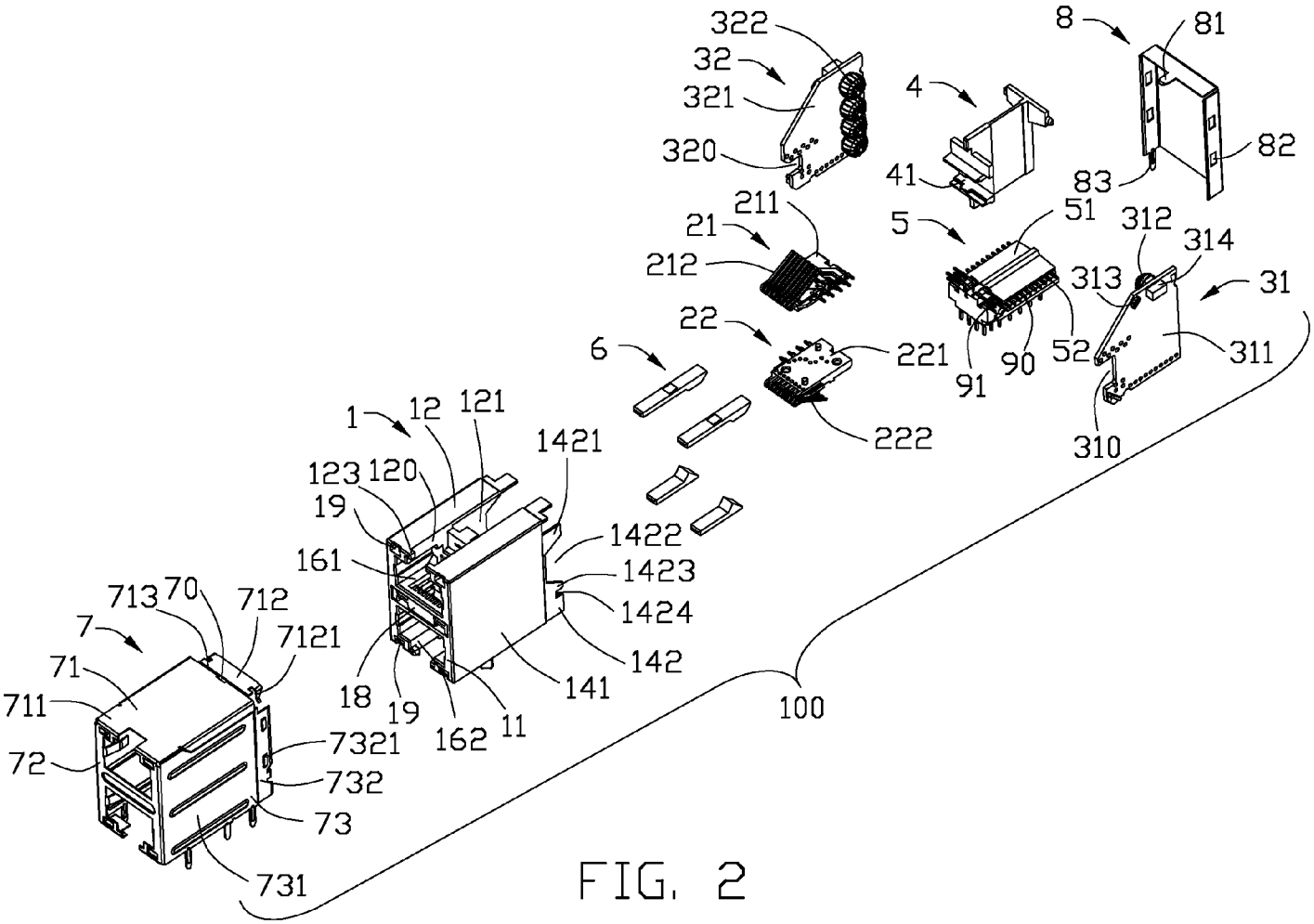
FIG. 2 is an exploded view of the electrical connector shown in FIG. 1.

Referring to FIG. 2, the electrical connector 100 includes an insulative housing 1, a lower mating contact module 22, an upper mating contact module 21, a first vertical PCBA (printed circuit board assembly) 31, a second vertical PCBA 32, a middle bracket 4, a mounting contact module 5, a plurality of light pipes 6, a front shielding shell 7, and a rear shielding shell 8.

Figure 3:
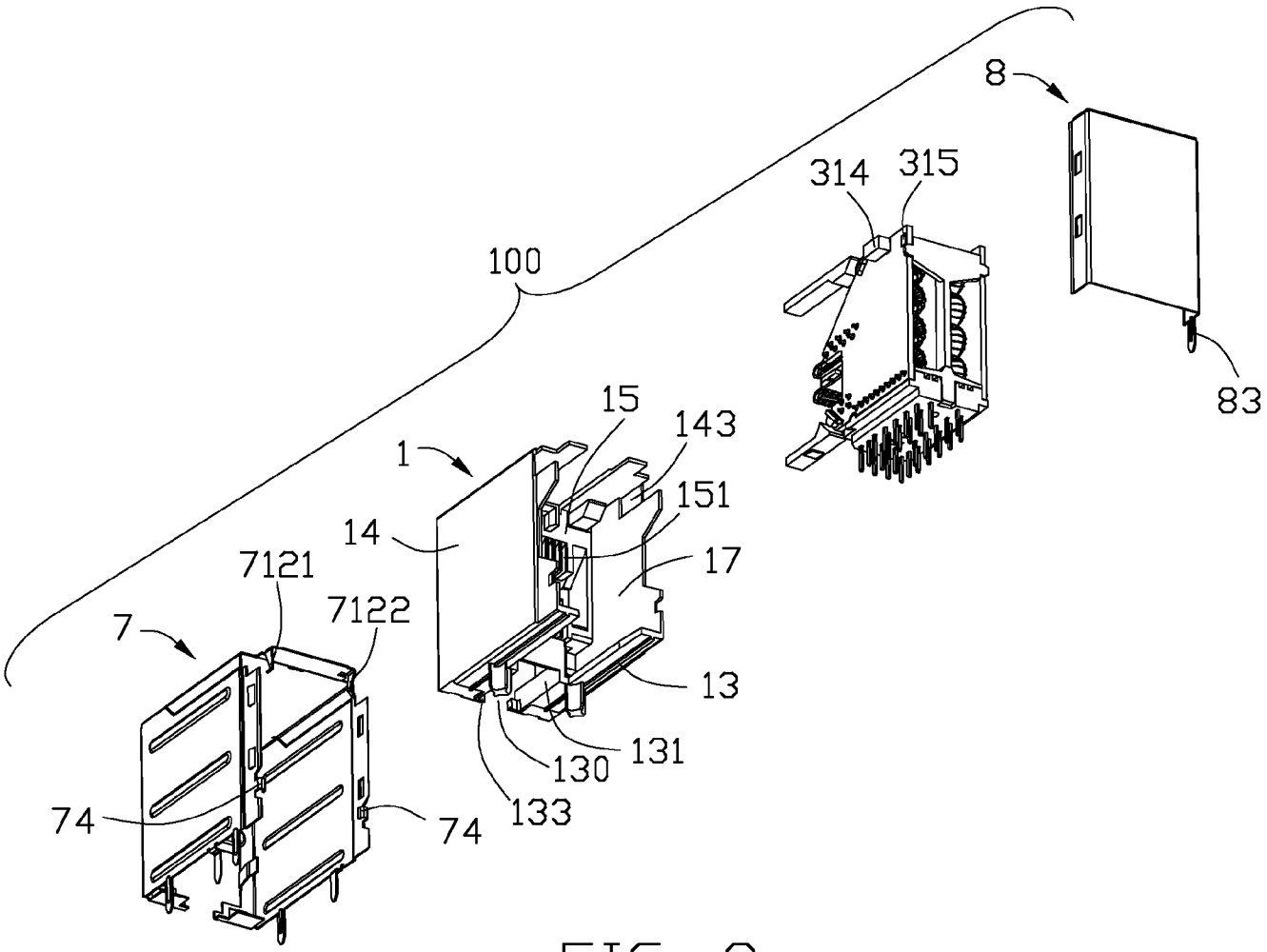
FIG. 3 is another exploded view of the electrical connector shown in FIG. 1.

Referring to FIGS. 2-3, the insulative housing 1 has a front wall 11, a top wall 12, a bottom wall 13, an intermediate wall 18, two side walls 14, and a middle wall 15 disposed between the side walls 14 and perpendicular to the intermediate wall 18. The insulative housing 1 defines a lower receiving cavity 162 located below the intermediate wall 18, an upper receiving cavity 161 located above the intermediate wall 18, and a mounting cavity 17 located behind the middle wall 15. The upper and lower receiving cavities 161, 162 are recessed backwardly from the front wall 11. The mounting cavity 17 is surrounded by the top wall 12, the bottom wall 13, the middle wall 15, and the side walls 14. The middle wall 15 separates the receiving cavities 161, 162 with the mounting cavity 17. The middle wall 15 also defines a plurality of positioning groove 151 extending along a front-to-back direction and communicates with the receiving cavities 161, 162 with the mounting cavity 17. After assembling the lower mating contact module 22, the upper mating contact module 21, the first vertical PCBA 31, the second vertical PCBA 32, the middle bracket 4, the mounting contact module 5 together to form a contact module, the contact module is mounted into the mounting cavity 17.

The lower and upper receiving cavities 162, 161 are used for insertion of two plug connectors (not shown), respectively. The top wall 12 has a top latching slit 120 and two lateral latching posts 123 protruding into the top latching slit 120 for latching with one plug connector. The top latching slit 120 extends through the top wall 12 along a top-to-bottom direction and communicates to the upper receiving cavity 161. The top wall 12 also defines a first through slot 121 located behind the top latching slit 120 and communicates to the top latching slit 120. The first through slot 121 communicates with the mounting cavity 17 along the top-to-bottom direction. The bottom wall 13 has a bottom latching slit 130 and two lateral latching posts 133 protruding into the bottom latching slit 130 for latching with one plug connector. The bottom latching slit 130 extends through the bottom wall 13 along the top-to-bottom direction and communicates to the lower receiving cavity 162. The bottom wall 13 also defines a second through slot 131 located behind the bottom latching slit 130 and communicates to the bottom latching slit 130. The second through slot 131 communicates with the mounting cavity 17 along a bottom-to-top direction.

The top latching slit 120 together with the first through slot 121 extends through the top wall 12 along the front-to-back direction. The bottom latching slit 130 together with the second through slot 131 extends through the bottom wall 13 along the front-to-back direction. There is only one mold die core molding backwardly to form the latching slits 120, 130 without a slider core running along the top-to bottom direction when injection molding the insulative housing 1. This structure reduces the complexity of the injection molding and the manufacture cost of the insulative housing 1.

Referring to FIGS. 2-5, the intermediate wall 18 defines a lower passageway 182 extending along the front-to-back direction and an upper passageway 181 disposed above the lower passageway 181. The insulative housing 1 has a lower locking spur 1821 protruding upwardly into the lower passageway 182, and an upper locking spur 1811 protruding downwardly into the upper passageway 181. The insulative housing 1 defines a number of mounting passageways 19 located below the lower receiving cavity 162 or above the upper receiving cavity 161. Each mounting passageway 19 includes a front passageway 191 extending through the front wall 18 along the back-to-front direction and a rear passageway 192 extending through the middle wall 15 along the front-to-back direction. The height H1 of the front passageway 191 along the top-to-bottom direction is greater than the height H2 of the rear passageway. Each light pipe 6 is mounted in one corresponding mounting passageway 19. The light pipe 6 has a rib 61 protruding upwardly or downwardly and received in the front passageway 191 to engage with the insulative housing 1.

Each side wall 14 includes a main body portion 141 and an extending portion 142 extending backwardly therefrom. The extending portion 142 has a top extending portion 1421, a lower extending portion 1423, and an abdicating groove 1422 located between the top and lower extending portions 1421, 1423. The lower extending portion 1423 defines a notch 1424 recessed along the back-to-front direction. The abdicating groove 1422 is used to easily assemble the first and second vertical PCBA 31, 32 to the insulative housing 1 or take out therefrom.

The upper mating contact module 21 is stacked on the lower mating contact module 22. The upper mating contact module 21 has an upper insulating carrier 211 and a set of upper mating contacts 212 secured to the upper insulating carrier 211. Each upper mating contact 212 includes an upper contacting portion 2121 extending upwardly and backwardly into the upper receiving cavity 161, an upper retention portion (not labeled) buried in the upper insulating carrier 211, and an upper connecting portion 2123 connected with the first vertical PCBA 31. The lower mating contact module 22 has a lower insulating carrier 221 and a set of lower mating contacts 222 secured to the lower insulating carrier 221. Each lower mating contact 222 includes an lower contacting portion 2221 extending upwardly and backwardly into the lower receiving cavity 162, a lower retention portion (not labeled) buried in the lower insulating carrier 221, and a lower connecting portion 2223 connected with the second vertical PCBA 32.

The upper insulating carrier 211 includes an upper fixing arm 213 inserted and fixed in the upper passageway 181. The upper fixing arm 213 has an upper locking barb 2131 protruding upwardly and engaged with the upper locking spur 1811. The lower insulating carrier 221 includes a lower fixing arm 223 inserted and fixed in the lower passageway 182. The lower fixing arm 223 has a lower locking barb 2231 protruding downwardly and engaged with the lower locking spur 1821. The upper and lower fixing arms 213, 223 are disposed at sides of the upper and lower insulating carrier 211, 213, respectively.

Referring to FIGS. 2, the first PCBA 31 includes a first PCB 311, a plurality of first transformers mounted on an inner face of the first PCB 311, a surface mounted type or surface mount technology (SMT) light-emitting diode (LED) 313, and a SMT capacitor 314. The SMT LED 313 and the SMT capacitor 314 are mounted on an outer face of the first PCB 311. The second PCBA 32 includes a second PCB 321, a plurality of second transformer 322 mounted on an inner face of the second PCB 321, and a SMT LED and a SMT capacitor mounted on an outer face of the second PCB 321. The first and second PCBs 31, 32 are disposed vertically and parallel to each other. The middle bracket 4 defines a front mounting groove 41 for mounting the mating contact module 21, 22 thereto. The first PCB 31 defines a first cutout 310 recessed backwardly from a front edge of the first PCB 31. The second PCB 32 defines a second cutout 320 recessed backwardly from a front edge of the second PCB 31. The top and lower fixing arms 213, 223 are received in the first and second cutouts 310, 320, respectively. The insulative housing 1 has an inner side wall with a recess 143 for at least partly receiving the SMT capacitor 314 therein, so that the size of the electrical connector 100 could be reduced.

Figure 4:
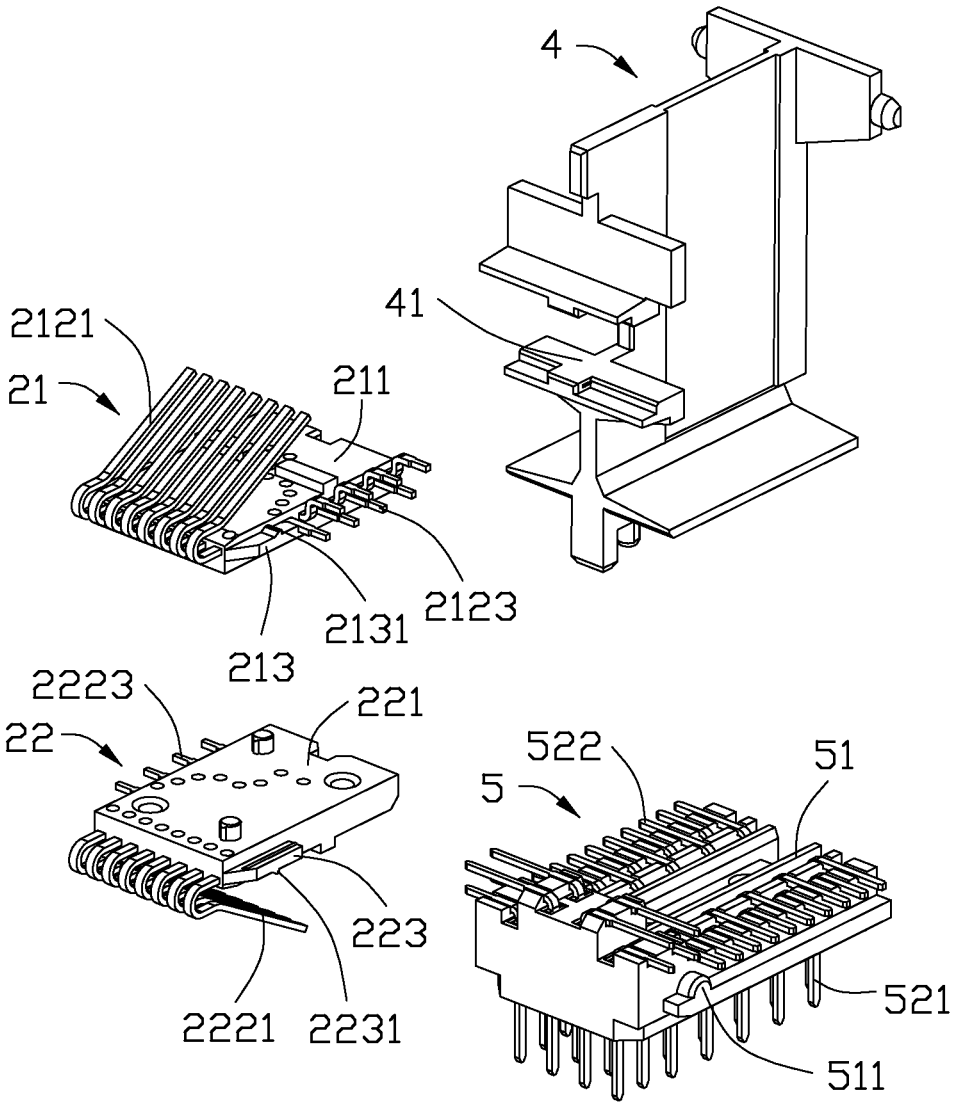
FIG. 4 is a perspective view of two mating contact modules, a middle bracket, and a mounting contact module shown in FIG. 1.
Figure 5:
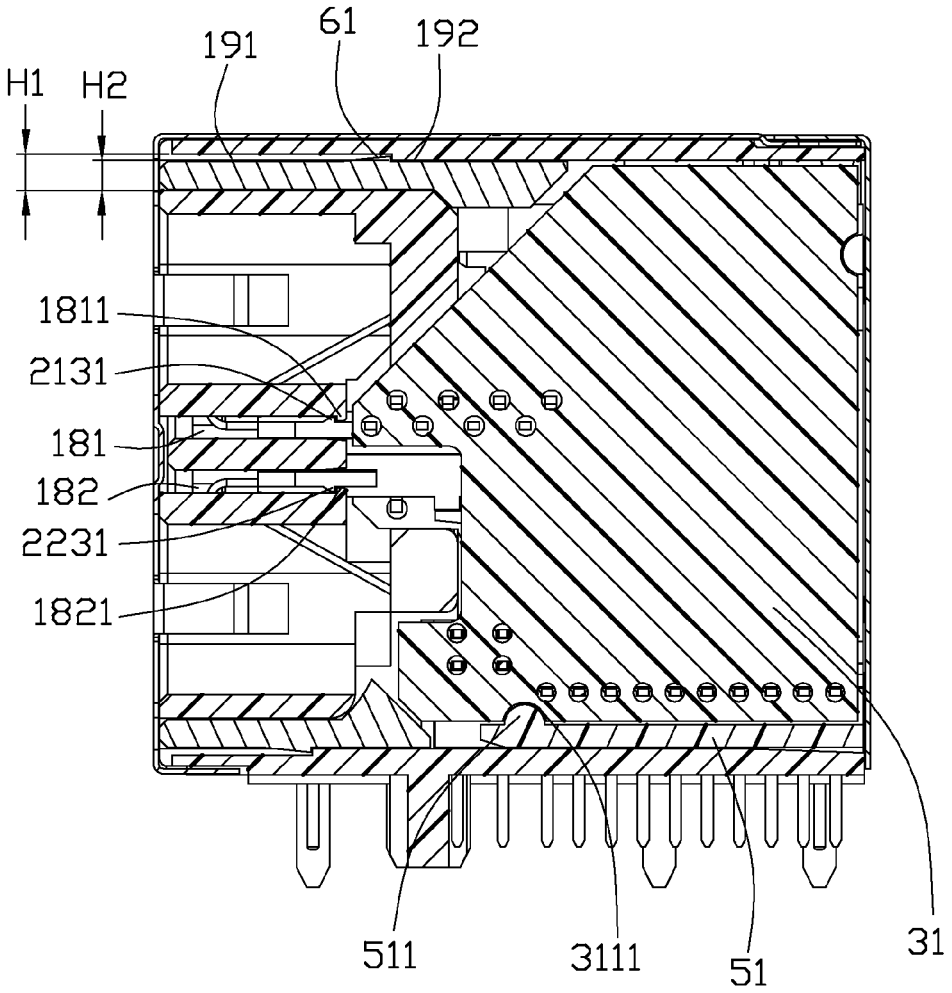
FIG. 5 is a cross-sectional view of the electrical connector, shown in FIG. 1.

Referring to FIGS. 2-4, the mounting contact module 5 has an insulating body 51 and a plurality of mounting contacts 52 hold by the insulating body 51. The mounting contacts 52 includes a set of first mounting contacts (not labeled) connected to the first PCB 311 and a set of second mounting contact (not labeled) connected to the second PCB 321. Both of the first and second mounting contacts have a row of signal contacts 90 and two rows of LED contacts 91 located in front of the signal contacts 90. The insulating body 51 has a positioning post 511 protruding upwardly, and the first PCB 31 defines a positioning trough 3111 for the positioning post 511 inserted therein.

Figure 1:
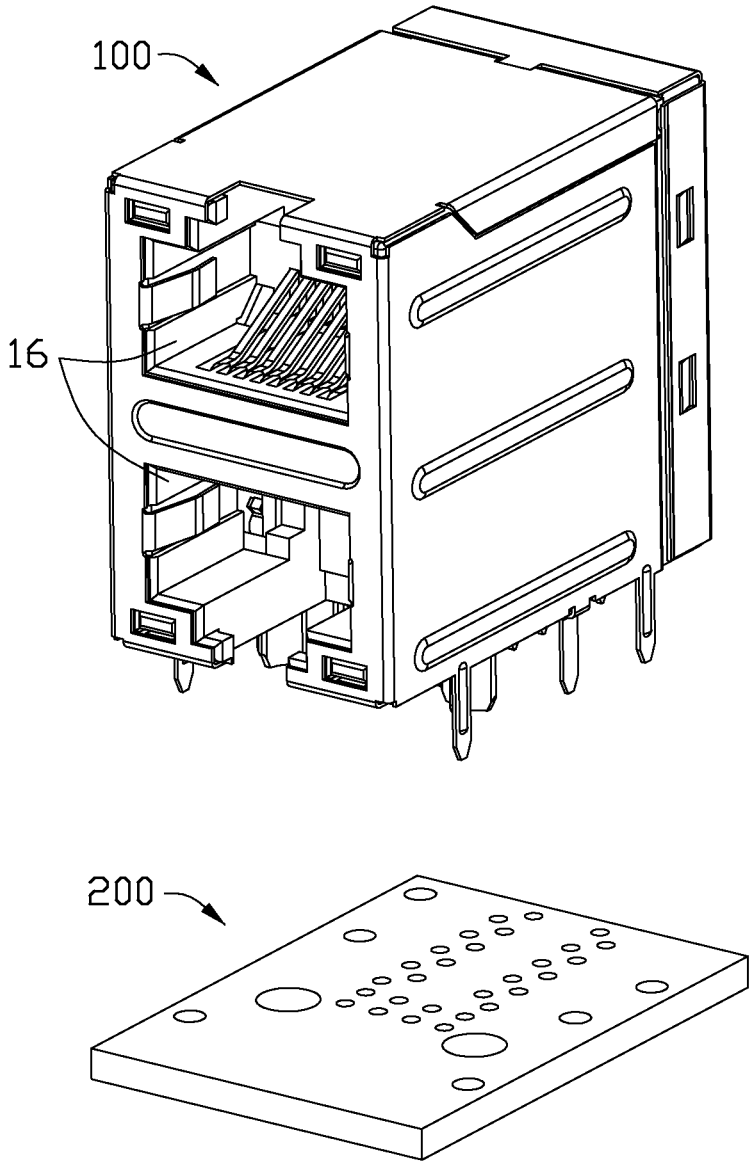
FIG. 1 is a perspective view of an electrical connector according to the present invention, and a horizontal mother printed circuit board (PCB) for the electrical connector mounting thereon.

Referring to FIGS. 1-3, the front shielding shell 7 and the rear shielding shell 8 are assembled together to enclose the insulative housing 1, the first PCBA 31, and the second PCBA 32. The rear shielding shell 8 has a tap 81 protruding forwardly, and the front shielding shell 7 defines an insertion hole 70 for the tap 81 inserted therein. Through mating the tap 81 with the insertion hole 70, it is easy to assemble the rear shielding 8 to the front shielding 7, and a top wall of rear shielding 8 can not turn upwardly. The front shielding shell 7 includes a top wall 71, a front wall 72, and two side walls 73 connecting with the top wall 71 and front wall 72. The top wall 71 has a first plate section 711, a second plate section 712 disposed below and behind the first plate section 711, and a connecting section 713 located between the first and second plate sections 711, 712. The insertion hole 70 is disposed at the connecting portion 713. The second plate section 712 has two cantilevered beams 7121 extending downwardly to connect with a conductive pad 315 of the first and second PCBs 311, 321 respectively. Each side wall 73 has a third plate section 731 and a fourth plate section 732 extending backwardly therefrom. The fourth plate section 732 has a protruding portion 7321, and the rear shielding shell 8 has an engaging hole 82 locking with the protruding portion 732. The front shielding shell 7 has a hook tap 74 received in the notch 1424 and engaged with the side wall 14.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

an insulative housing having a lower receiving cavity, an upper receiving cavity, and an intermediate wall located therebetween;

a lower mating contact module having a lower insulating carrier and a set of lower mating contacts secured to the lower insulating carrier, each lower mating contact having a lower contacting portion extending downwardly and backwardly into the lower receiving cavity; and an upper mating contact module having an upper insulating carrier and a set of upper mating contacts secured to the upper insulating carrier, each upper mating contact having an upper contacting portion extending upwardly and backwardly into the upper receiving cavity;

wherein the intermediate wall defines a lower passageway extending along a front-to-back direction and an upper passageway disposed above the lower passageway;

wherein the lower insulating carrier has a lower fixing arm inserted in the lower passageway, the upper insulating carrier has an upper fixing arm inserted in the upper passageway, and the fixing arms engage with the insulative housing;

wherein said lower fixing arm has a lower locking barb protruding downwardly, and said insulative housing has a lower locking spur protruding upwardly into the lower passageway for locking with the lower locking barb so as to prevent rearward movement of the lower mating contact module with regard to the housing.

2. The electrical connector as claimed in claim 1, wherein said upper fixing arm has an upper locking barb protruding upwardly, and said insulative housing has an upper locking spur protruding downwardly into the upper passageway for locking with the upper locking barb.

3. The electrical connector as claimed in claim 1, wherein said lower and upper fixing arms are disposed at sides of the lower and upper insulating carrier, respectively.

4. The electrical connector as claimed in claim 1, wherein each of the lower and upper passageways extends through the intermediate wall along the front-to-back direction.

5. The electrical connector as claimed in claim 1, further including a front shielding shell and a rear shielding shell enclosing the insulative housing, the rear shielding shell having a tap protruding forwardly, and the front shielding shell defining an insertion hole receiving the tap.

6. The electrical connector as claimed in claim 5, wherein the front shielding shell includes a top wall having a first plate section, a second plate section disposed below and behind the first plate section, and a connecting section located between the first and second plate sections, the connecting section defining the insertion hole.

7. The electrical connector as claimed in claim 6, further including a first vertical printed circuit board (PCB) connected with the lower mating contacts, a second vertical PCB connected with the upper mating contacts, and a middle bracket disposed between the first and second vertical PCBs, the first vertical PCB mounted on a side of the middle bracket, the second vertical PCB mounted on an opposite side of the middle bracket.

8. The electrical connector as claimed in claim 7, wherein said second plate section has a cantilevered beam extending downwardly to connect with one of the first and second vertical PCBs.

9. The electrical connector as claimed in claim 7, wherein said first vertical PCB has a capacitor mounted on a surface thereof, and the insulative housing has an inner side wall with a recess for receiving the capacitor.

10. The electrical connector as claimed in claim 6, wherein said insulative housing includes a side wall defining a notch recessed from a rear edge of the side wall along a back-to-front direction, and the front shielding shell has a hook tap received in the notch and engaged with the side wall.

11. The electrical connector as claimed in claim 1, wherein the insulative housing includes opposite top wall and bottom wall, each one of said top wall and bottom wall defining a latching slit for latching with a plug connector and a through slot located behind the latching slit, and wherein the latching slit together with the through slot extends through the corresponding one of the top wall and the bottom wall along said front-to-back direction.

12. An electrical connector comprising:

an insulative housing forming opposite upper and lower receiving cavities in a vertical direction;

a lower mating contact module disposed in the lower receiving cavity and including a lower insulating carrier retaining a plurality of lower contacts thereto;

an upper mating contacting module disposed in the upper receiving cavity and including an upper insulative carrier retaining a plurality of upper contacts thereto;

the lower insulating carrier and the upper insulating carrier assembled to each other in the vertical direction;

at least one lower fixing arm formed on a lateral edge of the lower insulating carrier to engage the housing in a front-to-back direction perpendicular to said vertical direction for preventing rearward movement relative to the housing; and at least one upper fixing arm formed on a lateral edge of the upper insulating carrier to engage the housing in the front-to-back direction for preventing rearward movement relative to the housing; wherein the lower fixing arm forms thereon a locking barb protruding in the vertical direction, and the upper fixing arm forms thereon another locking barb protrusion in the vertical direction; wherein the insulative housing forms an upper locking spur latched with the locking barb of the upper fixing arm, and the a lower locking spur latched with the locking barb of the lower fixing arm.

13. The electrical connector as claimed in claim 12, wherein said upper insulating carrier is intimately and directly stacked upon said lower insulating carrier and in the vertical direction.

14. The electrical connector as claimed in claim 12, wherein the housing includes a middle wall surrounding two opposite lateral edges and a front edge of the lower insulating carrier at a lower level, and surrounding two opposite lateral edges and a front edge of the upper insulating carrier at an upper level, and wherein the middle wall forms a lower passageway to receive said lower fixing arm, and an upper passageway to receive said upper fixing arm.

15. The electrical connector as claimed in claim 12, wherein the insulative housing includes opposite top wall and bottom wall, each one of said top wall and said bottom wall defining a latching slit for latching with a plug connector and a through slot located behind the latching slit, and wherein the latching slit together with the through slot extends through the corresponding one of the top wall and the bottom wall along said front-to-back direction.

16. The electrical connector as claimed in claim 12, wherein along the front-to-back direction, the upper fixing arm defines a first dimension and the upper insulative carrier defines a second dimension, said first dimension be less than one half of said second dimension.

17. The electrical connector as claimed in claim 16, wherein tails of the upper contacts extend laterally out of a lateral side of the upper insulating carrier behind the corresponding upper fixing arm.

18. An electrical connector comprising:

an insulative housing forming opposite upper and lower receiving cavities in a vertical direction;

a lower mating contact module disposed in the lower receiving cavity and including a lower insulating carrier retaining a plurality of lower contacts thereto;

an upper mating contacting module disposed in the upper receiving cavity and including an upper insulative carrier retaining a plurality of upper contacts thereto; and the lower insulating carrier and the upper insulating carrier assembled to each other in the vertical direction; wherein one of the lower contacting module and the upper contacting module includes a fixing arm on a lateral edge thereof to engage the housing in a front-to-back direction perpendicular to said vertical direction for preventing rearward movement relative to the insulative housing; wherein the fixing arm forms thereon a locking barb protruding in the vertical direction; wherein the insulative housing further includes a middle wall to essentially surround the assembled upper insulating carrier and lower insulating carrier except a rear side thereof, said middle wall defining a passageway in which said fixing arm is received; wherein the passageway defines therein a locking spur against which the locking barb abuts for sufficiently preventing rearward movement relative to the housing in the front-to-back direction.

19. The electrical connector as claimed in claim 18, wherein along the front-to-back direction, the upper fixing arm defines a first dimension and the upper insulative carrier defines a second dimension, said first dimension be less than one half of said second dimension.

20. The electrical connector as claimed in claim 19, wherein tails of the upper contacts extend laterally out of a lateral side of the upper insulating carrier behind the corresponding upper fixing arm.

* * * * *